US008687991B2

(12) United States Patent
Ando et al.

(10) Patent No.: US 8,687,991 B2
(45) Date of Patent: Apr. 1, 2014

(54) IMAGE FORMING APPARATUS AND IMAGE FORMING METHOD

(75) Inventors: Hiroki Ando, Kanagawa (JP); Toshie Nakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 210 days.

(21) Appl. No.: 13/398,958

(22) Filed: Feb. 17, 2012

(65) Prior Publication Data

US 2013/0028625 A1 Jan. 31, 2013

(30) Foreign Application Priority Data

Jul. 29, 2011 (JP) ..... 2011-166678

(51) Int. Cl.
*G03G 15/00* (2006.01)
*G03G 21/12* (2006.01)
*G03G 15/01* (2006.01)

(52) U.S. Cl.
USPC ..... 399/72; 399/35; 399/301

(58) Field of Classification Search
USPC ..... 399/35, 72, 301
See application file for complete search history.

(56) References Cited

FOREIGN PATENT DOCUMENTS

| | | |
|---|---|---|
| JP | 2000-019915 A | 1/2000 |
| JP | 2003-271023 A | 9/2003 |

*Primary Examiner* — Clayton E LaBalle
*Assistant Examiner* — Jas Sanghera
(74) *Attorney, Agent, or Firm* — Sughrue Mion, PLLC

(57) ABSTRACT

An image forming apparatus includes an image forming unit that forms, on an image bearing member, an image for adjusting operations of the image forming apparatus, a container that contains toner removed from the image bearing member, and a controller that controls formation of the image for adjusting the operations of the image forming apparatus so that after an amount of toner contained in the container reaches a threshold value, an amount of toner removed from the image bearing member and to be contained in the container is reduced to less than before the amount of toner contained in the container reaches the threshold value.

8 Claims, 8 Drawing Sheets

51

| | BEFORE OUTPUTTING DETECTION SIGNAL | AFTER OUTPUTTING DETECTION SIGNAL |
|---|---|---|
| POWER-ON | EACH TIME | ONCE EVERY TWO TIMES |
| TEMPERATURE VARIATION | THRESHOLD VALUE T1 | THRESHOLD VALUE T2 |
| HUMIDITY VARIATION | THRESHOLD VALUE H1 | THRESHOLD VALUE H2 |

52

| | BEFORE OUTPUTTING DETECTION SIGNAL | AFTER OUTPUTTING DETECTION SIGNAL |
|---|---|---|
| POWER-ON | EACH TIME | ONCE EVERY TWO TIMES |
| NUMBER OF PRINTED SHEETS | THRESHOLD VALUE N1 | THRESHOLD VALUE N2 |
| TEMPERATURE VARIATION | THRESHOLD VALUE T3 | THRESHOLD VALUE T4 |
| HUMIDITY VARIATION | THRESHOLD VALUE H3 | THRESHOLD VALUE H4 |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2011-166678 filed Jul. 29, 2011.

BACKGROUND

1. Technical Field

The present invention relates to an image forming apparatus and an image forming method.

2. Summary

According to an aspect of the invention, there is provided an image forming apparatus including an image forming unit that forms, on an image bearing member, an image for adjusting operations of the image forming apparatus, a container that contains toner removed from the image bearing member, and a controller that controls formation of the image for adjusting the operations of the image forming apparatus so that after an amount of toner contained in the container reaches a threshold value, an amount of toner removed from the image bearing member and to be contained in the container is reduced to less than before the amount of toner contained in the container reaches the threshold value.

BRIEF DESCRIPTION OF THE DRAWINGS

An exemplary embodiment of the present invention will be described in detail based on the following figures, wherein.

DETAILED DESCRIPTION

Figure 1:
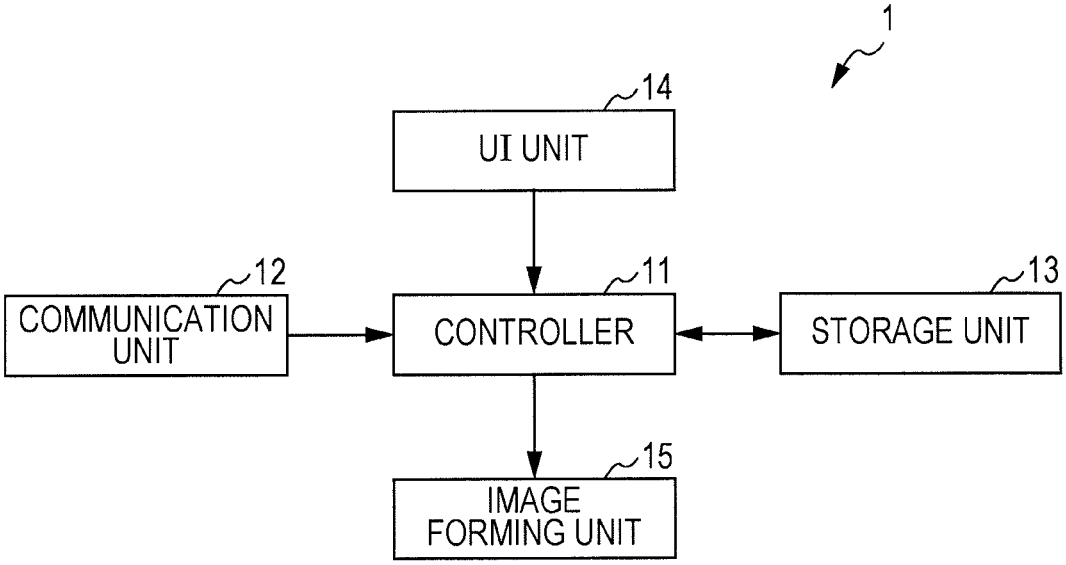
FIG. 1 is a block diagram of an exemplary configuration of an image forming apparatus according to an exemplary embodiment of the invention.

FIG. 1 is a block diagram of an exemplary configuration of an image forming apparatus 1 according to an exemplary embodiment of the invention. The image forming apparatus 1 is formed from an electrophotographic color printer. The image forming apparatus 1 includes a controller 11, a communication unit 12, a storage unit 13, a user interface (UI) unit 14, and an image forming unit 15. The controller 11 includes a central processing unit (CPU) and a memory. The CPU executes a program stored in the memory and controls units of the image forming apparatus 1. The communication unit 12 serves as a communication interface connected to a communication line. For example, if a computer apparatus transmits image data to the image forming apparatus 1, the image forming apparatus 1 receives the image data using the communication unit 12. The storage unit 13 is formed from a storage device, such as a hard disk. The storage unit 13 stores a variety of types of data. The UI unit 14 includes, for example, a touch screen and keys. The UI unit 14 is used for operating the image forming apparatus 1. The image forming unit 15 forms an image on a sheet of paper in accordance with the image data.

Figure 2:
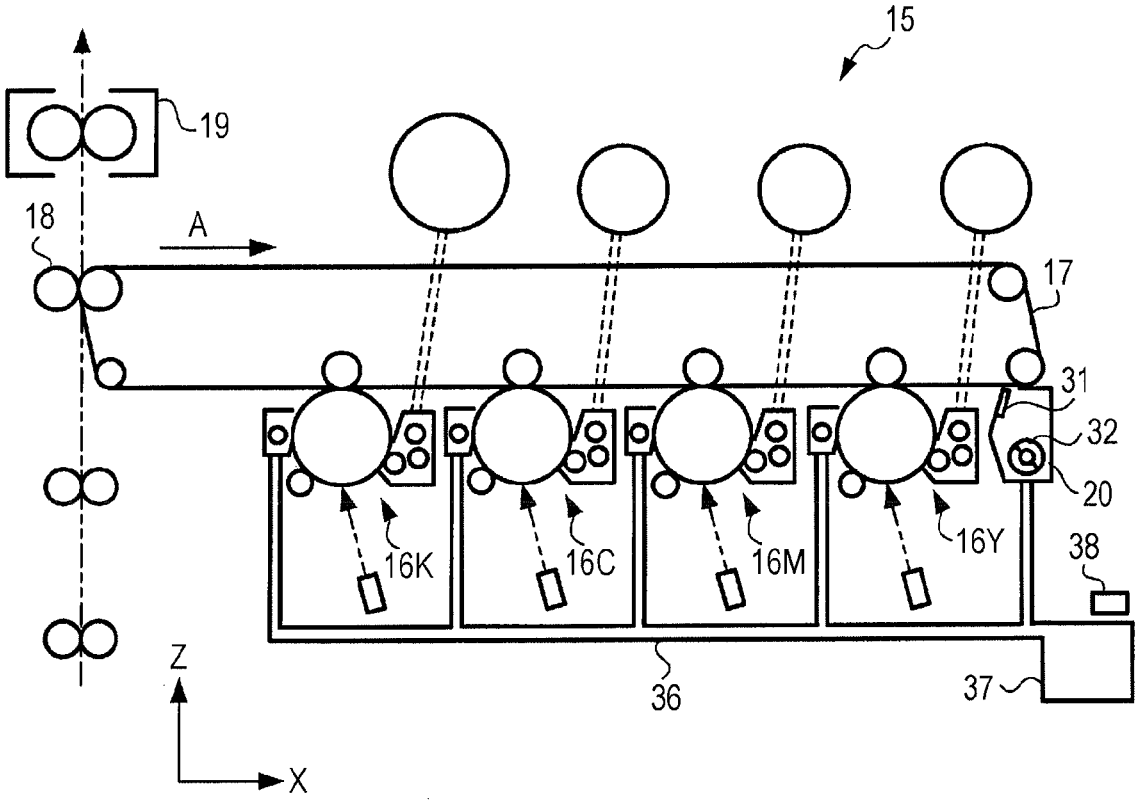
FIG. 2 is a schematic illustration of an exemplary configuration of an image forming unit.

FIG. 2 is a schematic illustration of an exemplary configuration of the image forming unit 15. The image forming unit 15 includes image forming engines 16Y, 16M, 16C, and 16K (examples of an image forming unit), an intermediate transfer belt 17, a second transfer roller 18, a fixing unit 19, and a cleaning device 20. The image forming engines 16Y, 16M, 16C, and 16K form images using yellow toner, magenta toner, cyan toner, and black toner, respectively, and transfer the generated images onto the intermediate transfer belt 17. When distinction among the image forming engines 16Y, 16M, 16C, and 16K is not necessary, the suffixes "Y", "M", "C", and "K" of the reference symbols are removed and are simply and collectively referred to as the "image forming engine 16". The intermediate transfer belt 17 rotates in a direction indicated by an arrow A illustrated in FIG. 2. Thus, the intermediate transfer belt 17 transports the images transferred by the image forming engines 16Y, 16M, 16C, and 16K towards the second transfer roller 18. That is, the intermediate transfer belt 17 is an example of an image bearing member that bears an image formed by the image forming engine 16. The second transfer roller 18 transfers the images transported by the intermediate transfer belt 17 onto a sheet of paper. The fixing unit 19 applies heat and pressure to the images on the sheet and fixes the images on the sheet. The sheet that has passed through the fixing unit 19 is ejected from the image forming apparatus 1.

The cleaning device 20 is disposed downstream of the second transfer roller 18. The cleaning device 20 removes residual toner remaining on a surface of the intermediate transfer belt 17. The cleaning device 20 includes a cleaning member 31 and a transport member 32. The cleaning member 31 has a blade shape. By urging the cleaning member 31 onto the intermediate transfer belt 17, the cleaning device 20 removes residual toner remaining on a surface of the intermediate transfer belt 17. The toner removed by the cleaning member 31 falls down into the housing of the cleaning device 20. The transport member 32 is disposed in the housing. The transport member 32 is rotated by a transport motor (not illustrated). The transport member 32 rotates and transports the toner in the housing to a transport path 36. Thereafter, the toner is transported to a waste toner container 37 (an example of a container) through the transport path 36 and is stored in the waste toner container 37.

Figure 3:
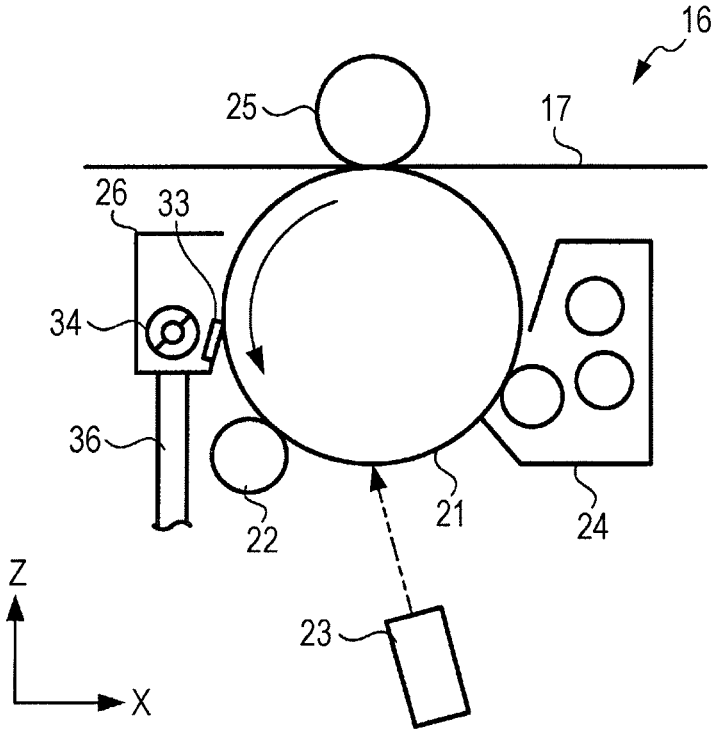
FIG. 3 illustrates an exemplary configuration of an image forming engine.

FIG. 3 illustrates an exemplary configuration of the image forming engine 16. The image forming engine 16 includes a photoconductor drum 21. The photoconductor drum 21 has a cylindrical shape. The photoconductor drum 21 has a photoconductive film on the surface thereof. An image is formed on the surface of the photoconductor drum 21. That is, the photoconductor drum 21 is an example of an image bearing member that bears a formed image. The photoconductor drum 21 is rotated about a shaft by a drum motor (not illustrated). A charging unit 22, an exposure device 23, a developing device 24, a first transfer roller 25, and a cleaning device 26 are disposed around the photoconductor drum 21. The charging unit 22 uniformly charges the surface of the photoconductor drum 21. The exposure device 23 performs an exposure operation on the charged photoconductor drum 21 in accordance with image data and forms an electrostatic latent image. The developing device 24 develops the electrostatic latent image formed on the photoconductor drum 21 with toner. The first transfer roller 25 transfers the image formed on the photoconductor drum 21 to the intermediate transfer belt 17.

The cleaning device 26 is disposed downstream of the first transfer roller 25 and removes residual toner remaining on the surface of the photoconductor drum 21. The cleaning device 26 includes a cleaning member 33 and a transport member 34. The cleaning member 33 has a blade shape. By urging the cleaning member 33 onto the surface of the photoconductor drum 21, the cleaning device 26 removes residual toner remaining on the surface of the photoconductor drum 21. The toner removed by the cleaning member 33 falls down into the housing of the cleaning device 26. The transport member 34 is disposed in the housing. The transport member 34 is rotated by a transport motor (not illustrated). The transport member 34 rotates and transports the toner in the housing to a transport path 36. Thereafter, the toner is transported to a waste toner container 37 through the transport path 36 and is stored in the waste toner container 37.

As illustrated in FIG. 2, the waste toner container 37 includes a detecting unit 38. The detecting unit 38 detects whether the amount of toner contained in the waste toner container 37 reaches a threshold value K1. If the amount of toner contained in the waste toner container 37 reaches the threshold value K1, the detecting unit 38 outputs a detection signal. The detecting unit 38 performs the detection using, for example, an optical sensor. The optical sensor includes a light emitting unit that emits light and a light receiving unit (not illustrated) that receives the light. The light emitting unit and the light receiving unit are disposed so as to face each other with the waste toner container 37 therebetween. Before the amount of toner contained in the waste toner container 37 reaches the threshold value K1, the light emitted from the light emitting unit is received by the light receiving unit through the inside of the waste toner container 37. If the amount of toner contained in the waste toner container 37 reaches the threshold value K1, the toner contained in the waste toner container 37 enters between the light emitting unit and the light receiving unit. At that time, the light emitted from the light emitting unit is blocked by the toner and, therefore, the amount of light received by the light receiving unit varies. In this way, it is detected that the amount of toner contained in the waste toner container 37 reaches the threshold value K1. According to the present exemplary embodiment, since the detecting unit 38 detects whether the amount of toner contained in the waste toner container 37 reaches the threshold value K1, it can be accurately detected that the amount of toner contained in the waste toner container 37 reaches the threshold value K1.

In response to a request from a user, the image forming apparatus 1 forms an image. In addition, in order to form an excellent image or maintain the image forming apparatus 1 in an excellent condition, the image forming apparatus 1 performs process control and color registration control (hereinafter referred to as "color regi control") and forms a toner band 45. In the process control, a pattern 41 is formed in order to control the density of an image. In the color regi control, a pattern 43 for correcting misalignment (an example of a color registration error correction image) is formed in order to correct an error that is caused by incorrect color registration among the images. Each of the pattern 41 for controlling the density, the pattern 43 for correcting misalignment, and the toner band 45 is not an image formed in response to a user request (hereinafter referred to as a "user image") but an image used for adjustment of the image forming apparatus 1. Accordingly, hereinafter, the pattern 41 for controlling the density, the pattern 43 for correcting misalignment, and the toner band 45 are referred to as "adjustment images". The adjustment images are not transferred to a sheet of paper. That is, an image used for adjustment of the image forming apparatus 1 is an image other than a user image. More specifically, an image used for adjustment of the image forming apparatus 1 is one of the pattern 41 for controlling the density, the pattern 43 for correcting misalignment, and the toner band 45.

Figure 4:
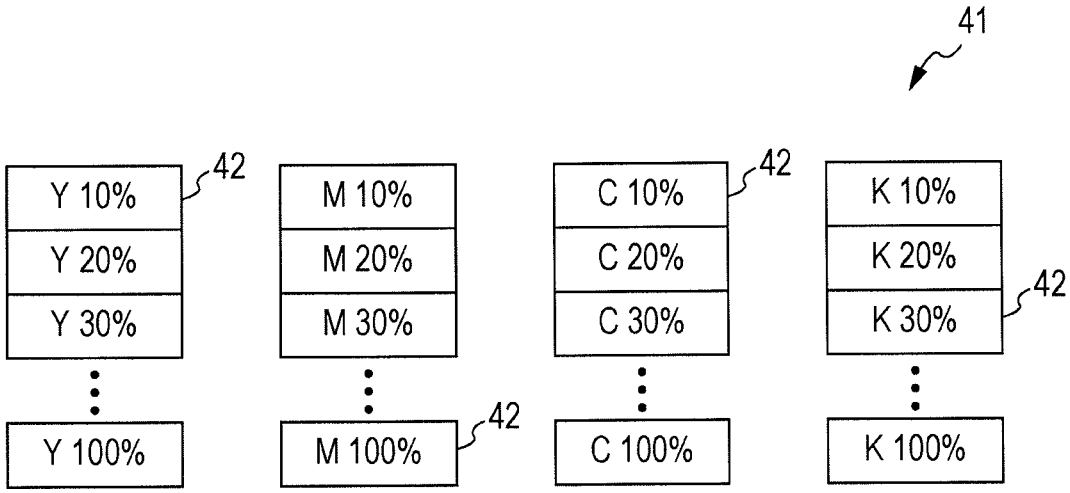
FIG. 4 illustrates an example of a pattern for correcting the density of an image.

FIG. 4 illustrates an example of the pattern 41 for controlling the density. The pattern 41 for controlling the density includes 10 patches 42 for each of the yellow (Y) color, magenta (M) color, cyan (C) color, and black (K) color. The ten patches for each of the colors have the densities from 0% to 100% with 10% increments. The pattern 41 for controlling the density is formed on the photoconductor drum 21 and, thereafter, is transferred onto the intermediate transfer belt 17. The intermediate transfer belt 17 has a sensor for measuring the density of the pattern 41 for controlling the density provided thereon (not illustrated). The controller 11 controls the density of an image in accordance with the density of the pattern 41 for controlling the density measured by the sensor. After the density is measured by the sensor, the pattern 41 for controlling the density is removed from the surface of the intermediate transfer belt 17 by the cleaning device 20.

Figure 5:
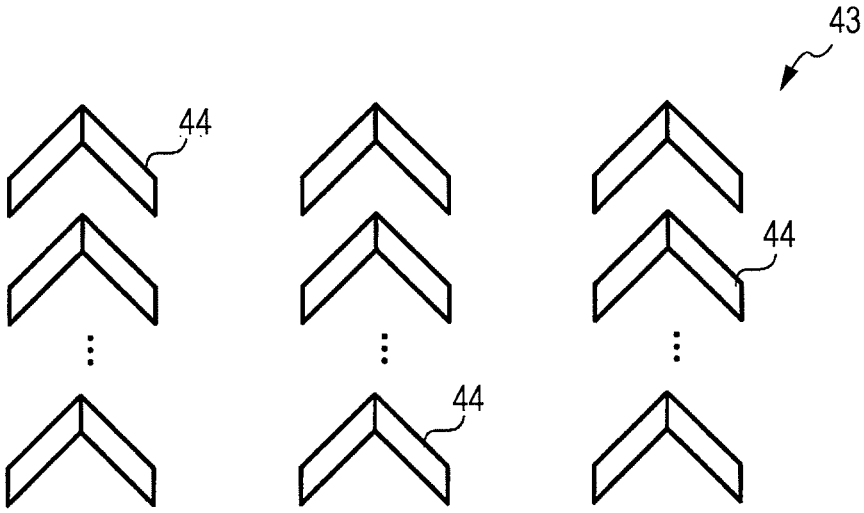
FIG. 5 illustrates an example of a pattern for correcting misalignment.

FIG. 5 illustrates an example of the pattern 43 for correcting misalignment. The pattern 43 for correcting misalignment includes plural chevron patches 44. The chevron patches 44 are formed from yellow toner, magenta toner, cyan toner, and black toner. The pattern 43 for correcting misalignment is formed on the photoconductor drum 21 and, thereafter, is transferred onto the intermediate transfer belt 17. The intermediate transfer belt 17 has a sensor for detecting the position of the pattern 43 for correcting misalignment provided thereon (not illustrated). The controller 11 corrects an error that is caused by incorrect color registration among the images in accordance with the position of the pattern 43 for correcting misalignment detected by the sensor. After the position is detected by the sensor, the pattern 43 for correcting misalignment is removed from the surface of the intermediate transfer belt 17 by the cleaning device 20.

Figure 6:
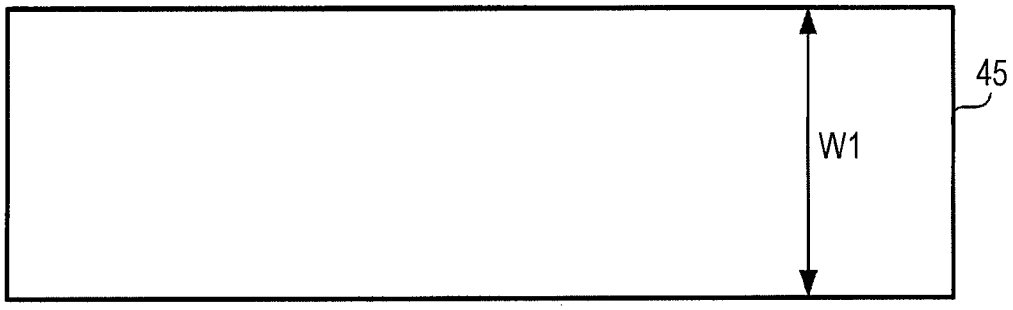
FIG. 6 illustrates an example of a toner band.

The toner band 45 indicates a strip-shaped image formed on the photoconductor drum 21 using yellow toner, magenta toner, cyan toner, or black toner. Two types of the toner band 45 are formed. One is formed for forcibly ejecting the toner inside the developing device 24. The other is formed for protecting the cleaning member 31 or 33. The toner band 45 formed for forcibly ejecting the toner inside the developing device 24 is described first. The developing device 24 contains toner. The toner is stirred in the developing device 24 by a stirring member. If, for example, images having a low density are continuously formed, the toner is stirred in the developing device 24 for a long period of time. Thus, the surface of a toner particle is removed and, therefore, the quality of the toner is deteriorated. Accordingly, in order to forcibly eject the deteriorated toner and introduce new toner, the toner band 45 is formed. FIG. 6 illustrates an example of the toner band 45. The toner band 45 has a width W1. The toner band 45 is formed on the photoconductor drum 21 so as to extend in the axis direction of the photoconductor drum 21. After the toner is ejected, new toner is supplied from a toner supply unit. In this way, deteriorated toner in the developing device 24 is replaced with new toner. The toner band 45 formed on the photoconductor drum 21 is not transferred onto the intermediate transfer belt 17. Thus, the toner band 45 remains on the surface of the photoconductor drum 21. The toner band 45 is removed from the surface of the photoconductor drum 21 by the cleaning device 26.

The toner band 45 formed for protecting the cleaning member 31 or 33 is described next. As described above, the cleaning members 31 and 33 are urged against the surfaces of the intermediate transfer belt 17 and the photoconductor drum 21, respectively. Accordingly, if the amount of toner that reaches the cleaning member 31 or 33 is small, the cleaning member 31 or 33 becomes worn due to a friction between the cleaning member 33 and the intermediate transfer belt 17 or between the cleaning member 31 and the photoconductor drum 21. In order to protect the cleaning members 31 and 33, the toner band 45 illustrated in FIG. 6 is formed. For example, if the toner band 45 is formed in order to protect the cleaning member 33, the toner band 45 is formed on the photoconductor drum 21 and is not transferred to the intermediate transfer belt 17. Thus, the toner band 45 remains on the surface of the photoconductor drum 21. Accordingly, if the toner band 45 is formed on the photoconductor drum 21, the toner band 45 directly reaches the cleaning member 33. When the toner band 45 reaches the cleaning member 33, the toner band 45 functions as a lubricant agent for the cleaning member 33. In this way, a friction between the cleaning member 33 and the photoconductor drum 21 is reduced and, therefore, the cleaning member 33 is protected.

A user image is formed on the photoconductor drum 21. Thereafter, the user image is transferred onto a sheet of paper via the intermediate transfer belt 17, and the sheet is output. Accordingly, if a user image is formed, only a small amount of residual toner remains on the surface of the photoconductor drum 21 and, therefore, a small amount of toner is collected into the waste toner container 37. In contrast, an adjustment image is not transferred onto a sheet of paper. Accordingly, if an adjustment image is formed, all the toner that forms the adjustment image remains on the surface of the photoconductor drum 21 or the intermediate transfer belt 17. Thereafter, the toner is collected into the waste toner container 37. Thus, when an adjustment image is formed, the amount of toner collected after one image forming operation is performed is larger than when a user image is formed.

Figure 7:
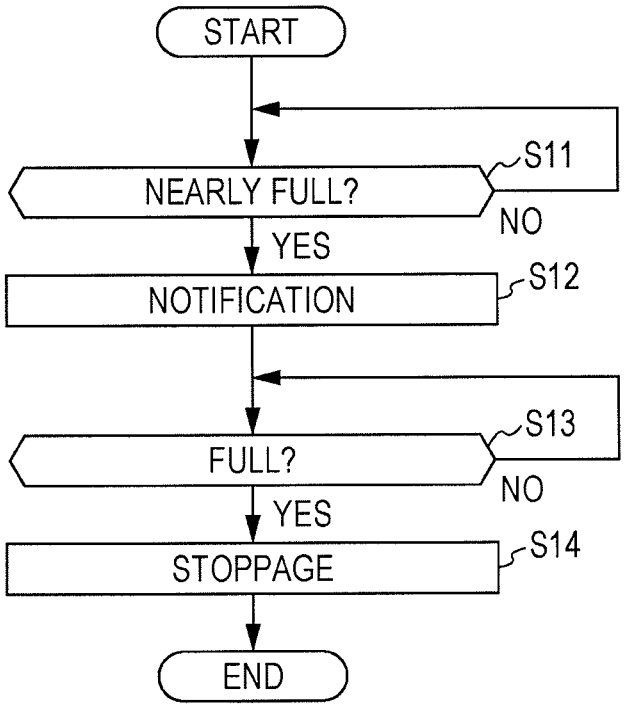
FIG. 7 is a flowchart of a process for detecting that a waste toner container is full.
Figures 8, 9:
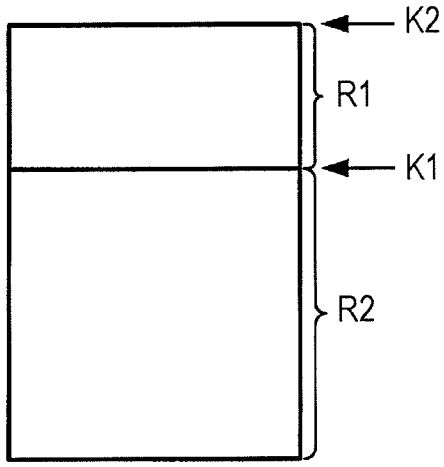
FIG. 8 illustrates the capacity of the waste toner container.
FIG. 9 illustrates an example of a control table for color regi control.

The controller 11 detects whether the waste toner container 37 is full. FIG. 7 is a flowchart of the detection process performed by the controller 11. The controller 11 determines whether the waste toner container 37 is nearly full (step S11). FIG. 8 illustrates the capacity of the waste toner container 37. As more images are formed, toner is more accumulated in the waste toner container 37. If the amount of toner in the waste toner container 37 is smaller than a threshold value K1, the detecting unit 38 does not output a detection signal. In such a case, the controller 11 determines that the waste toner container 37 is not nearly full (NO in step S11). However, if the amount of toner in the waste toner container 37 reaches the threshold value K1, the detecting unit 38 outputs a detection signal. In such a case, the controller 11 determines that the waste toner container 37 is nearly full (YES in step S11).

If the waste toner container 37 is nearly full, the controller 11 notifies the user of information indicating that the waste toner container 37 is nearly full (step S12). For example, the controller 11 instructs the UI unit 14 to display a message indicating that the waste toner container 37 is nearly full. The user is aware of the waste toner container 37 being nearly full due to the notification. Thereafter, the user prepares a new waste toner container that is to be mounted in place of the waste toner container 37. As illustrated in FIG. 8, the waste toner container 37 has a reserve capacity R1 so that the image forming apparatus 1 can operate for a certain period of time (e.g., a week) after the waste toner container 37 becomes nearly full. The reserve capacity R1 is determined in accordance with, for example, a period of time necessary for the user to prepare a new waste toner container and the number of sheets to be printed during that period. For example, when a week is necessary for the user to prepare a new waste toner container and if 800 sheets are printed for a week, the reserve capacity R1 is determined so as to contain the amount of toner collected after 800 sheets are printed.

In addition, if the waste toner container 37 is nearly full, the controller 11 determines whether the waste toner container 37 is full on the basis of information regarding the use conditions of the image forming apparatus 1 (step S13). Examples of the use condition include the number of printed sheets and the number of pixels. In this case, if the waste toner container 37 is nearly full, the controller 11 starts measuring the number of printed sheets and the number of pixels. More specifically, the controller 11 counts the number of sheets on which images are formed and stores, as a first number of printed sheets, the number of sheets in a memory. In addition, the controller 11 counts the number of pixels to be included in the image data supplied to the exposure device 23, that is, the number of dots of the images formed on the photoconductor drum 21 and stores the counted number of pixels in the memory. If each of the first number of printed sheets and the number of pixels stored in the memory does not reach a threshold value, the controller 11 determines that the waste toner container 37 is not full (NO in step S13). However, if at least one of the first number of printed sheets and the number of pixels stored in the memory reaches the threshold value (YES in step S13), it is highly likely that the amount of toner in the waste toner container 37 reaches an upper limit K2. In such a case, the controller 11 determines that the waste toner container 37 is full (YES in step S13).

If toner is delivered into the waste toner container 37 after the waste toner container 37 becomes full, the toner spills out of the waste toner container 37. In order to prevent the toner from spilling out, if the controller 11 determines that the waste toner container 37 is full, the controller 11 stops the operation performed by the image forming unit 15 until the user replaces the waste toner container 37 (step S14). That is, if the amount of toner collected into the waste toner container 37 reaches the upper limit K2, the controller 11 stops the operation performed by the image forming unit 15.

In addition, after the detecting unit 38 outputs the detection signal, the controller 11 controls the frequency of the color regi control operation or the frequency of formation of the toner band 45 so that the amount of toner removed from the intermediate transfer belt 17 or the photoconductor drum 21 and collected into the waste toner container 37 is reduced. For example, the controller 11 controls the frequency of the color regi control operation using a control table 51. The control table 51 is prestored in the storage unit 13. FIG. 9 illustrates an example of the control table 51. The control table 51 includes information regarding the timing at which a color regi operation is performed before and after the detection signal is detected. The following two points in time are used for the timing information: a point in time at which the image forming apparatus 1 is powered on and a point in time at which a variation in the temperature or the humidity inside of the image forming apparatus 1 exceeds a threshold value. The temperature and the humidity inside of the image forming apparatus 1 are measured by a temperature sensor and a humidity sensor (neither is illustrated) mounted in the image forming unit 15.

In the control table 51 illustrated in FIG. 9, the frequency "each time" is specified for the timing "power-on" "before outputting detection signal". In such a case, each time the image forming apparatus 1 is powered on before the detecting unit 38 outputs a detection signal, the controller 11 performs the color regi control. In addition, in the control table 51, a "threshold value T1" is specified as a threshold value of a "temperature variation" "before outputting detection signal". Furthermore, a "threshold value H1" is specified as a threshold value of a "humidity variation" "before outputting detection signal". In such a case, if the temperature variation measured by the temperature sensor exceeds the threshold value T1 before the detecting unit 38 outputs a detection signal or if the humidity variation measured by the humidity sensor exceeds the threshold value H1 before the detecting unit 38 outputs a detection signal, the controller 11 performs the color regi control.

In addition, in the control table 51, the frequency "once every two times" is specified for the timing "power-on" "after outputting detection signal". In such a case, after the waste toner container 37 becomes nearly full and the detecting unit 38 outputs a detection signal, the controller 11 performs the color regi control only once every two power-on operations of the image forming apparatus 1. Furthermore, in the control table 51, a "threshold value T2" is specified as a threshold value of a "temperature variation" "after outputting detection signal". Still furthermore, a "threshold value H2" is specified as a threshold value of a "humidity variation" "after outputting detection signal". The threshold value T2 is greater than the threshold value T1. The threshold value H2 is greater than the threshold value H1. In such a case, after the detecting unit 38 outputs the detection signal and before the temperature variation measured by the temperature sensor exceeds the threshold value T2 or before the humidity variation measured by the humidity sensor exceeds the threshold value H2, the controller 11 does not perform the color regi control. Thus, after the detecting unit 38 outputs the detection signal, the frequency of performance of the color regi control, that is, the frequency of formation of the pattern 43 for correcting misalignment is decreased.

Figures 10, 11:
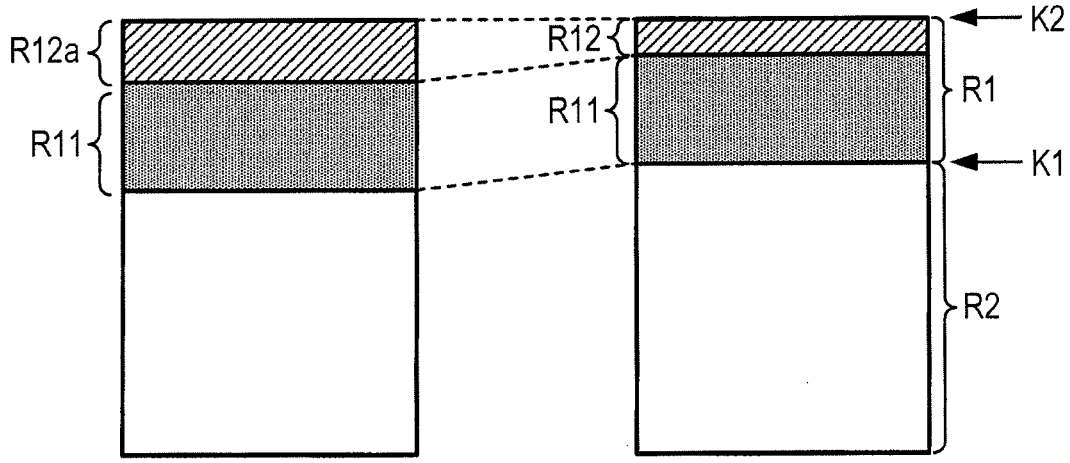
FIG. 10 illustrates an example of a control table for protection toner band.
FIG. 11 illustrates a planned capacity and a margin capacity.

In addition, the controller 11 controls the frequency of formation of the toner band 45 for protecting the cleaning member 31 (hereinafter referred to as a "protection toner band 45") using a control table 52. The control table 52 is prestored in the storage unit 13. FIG. 10 illustrates an example of the control table 52. The control table 52 contains information regarding the timing at which the protection toner band 45 is formed before and after the detection signal is output. The protection toner band 45 is formed when the image forming apparatus 1 is powered on, when the number of printed sheets counted since the toner band 45 was previously formed exceeds a threshold value, and when a temperature variation or a humidity variation inside the image forming apparatus 1 exceeds a threshold value. In this case, when the protection toner band 45 is formed, the controller 11 starts counting the number of sheets having images formed thereon and stores, in a memory, the counted number of sheets as a second number of printed sheets. The temperature and the humidity inside the image forming apparatus 1 are measured by a temperature sensor and a humidity sensor (neither is illustrated) mounted in the image forming unit 15.

In the control table 52 illustrated in FIG. 10, the frequency "each time" is specified for the timing "power-on" "before outputting detection signal". In such a case, if the image forming apparatus 1 is powered on before the detecting unit 38 outputs a detection signal, the controller 11 forms the protection toner band 45 each time the image forming apparatus 1 is powered on. Furthermore, in the control table 52, a "threshold value N1" is specified as a threshold value of the "number of printed sheets" "before outputting detection signal". In this case, if the second number of printed sheets stored in the memory exceeds a threshold value N1 before the detecting unit 38 outputs a detection signal, the controller 11 forms the protection toner band 45. Still furthermore, in the control table 52, a "threshold value T3" is specified as a threshold value of the "temperature variation" "before outputting detection signal". A "threshold value H3" is specified as a threshold value of the "humidity variation" "before outputting detection signal". In this case, if the temperature variation measured by the temperature sensor exceeds the threshold value T3 or if the humidity variation measured by the humidity sensor exceeds the threshold value H3, the controller 11 forms the protection toner band 45.

In addition, in the control table 52, the frequency "once every two times" is specified for the timing "power-on" after "outputting detection signal". In such a case, after the waste toner container 37 becomes nearly full and the detecting unit 38 outputs a detection signal, the controller 11 performs formation of the protection toner band 45 only once every two power-on operations of the image forming apparatus 1. Furthermore, in the control table 52, a "threshold value N2" is specified as a threshold value of the "number of printed sheets" "after outputting detection signal". The threshold value N2 is greater than the threshold value N1. In this case, after the detecting unit 38 outputs the detection signal, the controller 11 does not form the protection toner band 45 until the second number of printed sheets stored in the memory exceeds the threshold value N2. Still furthermore, in the control table 52, a "threshold value T4" is specified as a threshold value of the "temperature variation". A "threshold value H4" is specified as a threshold value of the "humidity variation". The threshold value T4 is greater than the threshold value T3. The threshold value H4 is greater than the threshold value H3. In such a case, after the detecting unit 38 outputs the detection signal and before the temperature variation measured by the temperature sensor exceeds the threshold value T4 or before the humidity variation measured by the humidity sensor exceeds the threshold value H4, the controller 11 does not form the protection toner band 45. Thus, after the detecting unit 38 outputs the detection signal, the frequency of formation of the protection toner band 45 is decreased.

As described above, in the case where an adjustment image is formed, the amount of toner collected after one image formation is performed is larger than in the case where a user image is formed. Accordingly, as in the present exemplary embodiment, if the frequency of formation of the pattern 43 for correcting misalignment or the toner band 45 is decreased, the amount of toner collected into the waste toner container 37 is decreased after a detection signal is output.

In addition, unlike the case where a user image is formed, when the pattern 43 for correcting misalignment or the toner band 45 is formed, process control is not performed and the density of an image is not adjusted in advance. Accordingly, when the pattern 43 for correcting misalignment or the toner band 45 is formed, the density variation of the image is large. For example, when an image having a density of 10% is formed, an image having a density of 11% may be formed in reality. In such a case, the amount of toner collected into the waste toner container 37 is increased more than expected. In order to prevent toner from spilling over the waste toner container 37 even in such a case, the reserve capacity R1 of the waste toner container 37 includes a margin capacity R12 in addition to a planned capacity R11.

FIG. 11 illustrates the planned capacity R11 and the margin capacity R12. The reserve capacity R1 is predetermined so as to be equal to the estimated amount of toner to be collected from the time the waste toner container 37 becomes nearly full to the time the waste toner container 37 becomes full (hereinafter referred to as an "estimated amount of toner to be collected"). The margin capacity R12 is determined for collecting excess toner if an actual amount of collected toner is greater than the estimated amount of toner to be collected. When the pattern 43 for correcting misalignment or the toner band 45 is formed, a variation in the density of an image is large. Accordingly, a variation in the amount of actually collected toner with respect to the estimated amount of toner to be collected is large. In such a case, it is necessary to provide a margin capacity R12*a* to the planned capacity R11 of the waste toner container 37. In contrast, if, as in the present exemplary embodiment, the frequency of formation of the pattern 43 for correcting misalignment or the toner band 45 is decreased, a variation in the amount of actually collected toner with respect to the estimated amount of toner to be collected decreases. In such a case, the margin capacity R12 that is smaller than the margin capacity R12*a* can be provided to the planned capacity R11 of the waste toner container 37. In this way, if the margin capacity is reduced from R12*a* to R12, a capacity R2 obtained by subtracting the reserve capacity R1 from the capacity of the waste toner container 37 is increased. In this case, the number of sheets printed before the waste toner container 37 becomes nearly full increases. Alternatively, if the capacity R2 remains unchanged, the size of the waste toner container 37 can be reduced by a difference between the margin capacity R12*a* and the margin capacity R12.

According to the present exemplary embodiment, the amount of toner removed from the intermediate transfer belt 17 or the photoconductor drum 21 after the amount of toner collected into the waste toner container 37 reaches the threshold value K1 decreases. Thus, the amount of toner collected into the waste toner container 37 is decreased to less than in the case where formation of the adjustment image is not controlled.

The present invention is not limited to the above-described exemplary embodiment. The above-described exemplary embodiment may be modified in the following manner. In addition, any of the following modifications may be combined together.

Modification 1

In the above-described exemplary embodiment, the amount of toner removed from the intermediate transfer belt 17 or the photoconductor drum 21 and collected into the waste toner container 37 is reduced by reducing the frequency of performance of color regi control or the frequency of formation of the toner band 45. However, another technique for reducing the amount of toner collected into the waste toner container 37 can be employed.

Figure 12:
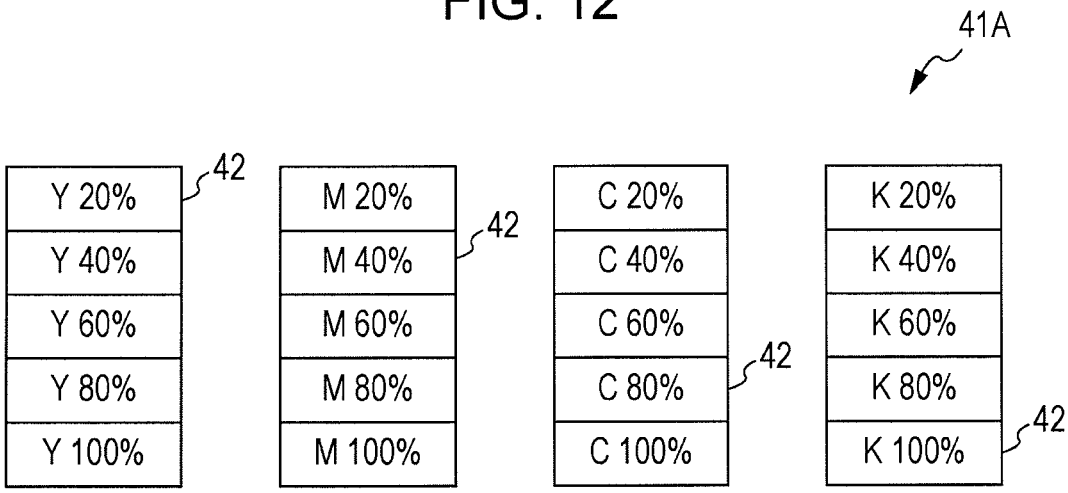
FIG. 12 illustrates an example of a pattern for correcting the density according to a modification of the exemplary embodiment.

As illustrated in FIG. 4, the pattern 41 for controlling the density includes plural patches 42 (examples of partial images). The controller 11 may reduce the number of the patches 42 included in the pattern 41 for controlling the density. FIG. 12 illustrates an example of a pattern 41A for controlling the density of an image according to the present modification. The pattern 41A for controlling the density includes five patches for each of the yellow color, magenta color, cyan color, and black color. The five patches for each of the colors have the densities from 0% to 100% with 20% increments. For example, before the detecting unit 38 outputs a detection signal, the controller 11 instructs the image forming unit 15 to form the pattern 41 for controlling the density including ten patches for each of the yellow color, magenta color, cyan color, and black color illustrated in FIG. 4. In contrast, after the detecting unit 38 outputs a detection signal, the controller 11 instructs the image forming unit 15 to form the pattern 41A for controlling the density including five patches for each of the yellow color, magenta color, cyan color, and black color illustrated in FIG. 12.

If the number of the patches 42 included in the pattern 41 for controlling the density is reduced in this manner, the amount of toner used for forming the pattern 41 for controlling the density is small. Accordingly, the amount of toner collected into the waste toner container 37 after the detecting unit 38 outputs a detection signal is small. Similarly, after the detecting unit 38 outputs a detection signal is small, the controller 11 may reduce the number of the chevron patches 44 (examples of partial images) included in the pattern 43 for correcting misalignment. In addition, if plural protection toner bands 45 are formed in one go, the controller 11 may reduce the number of the protection toner bands 45 after the detecting unit 38 outputs a detection signal. In such a case, each of the protection toner bands 45 is used as an example of a partial image.

Figure 13:
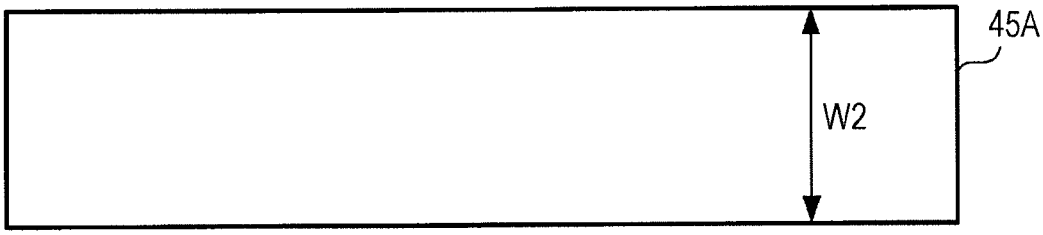
FIG. 13 illustrates an example of a toner band according to a modification of the exemplary embodiment.

Alternatively, the controller 11 may reduce the area of the protection toner band 45 by reducing the width of the protection toner band 45. As used herein, the term "width" refers to the length of the protection toner band 45 formed on the photoconductor drum 21 in the rotational direction of the photoconductor drum 21. FIG. 13 illustrates an example of a toner band 45A according to the present modification. A width W2 of the toner band 45A is smaller than the width W1 of the toner band 45 illustrated in FIG. 6. For example, before the detecting unit 38 outputs a detection signal, the controller 11 forms the toner band 45 having the width W1 illustrated in FIG. 6. In contrast, after the detecting unit 38 outputs a detection signal, the controller 11 forms the toner band 45A having the width W2 illustrated in FIG. 13. In such a case, the amount of toner used for forming the toner band 45 is small. Accordingly, the amount of toner collected into the waste toner container 37 after the detecting unit 38 outputs a detection signal is small. Similarly, after the detecting unit 38 outputs a detection signal, the controller 11 may reduce the area of the pattern 43 for correcting misalignment or the pattern 41 for controlling the density.

As described above, the controller 11 may change the adjustment image into a simpler adjustment image after the detection signal is output. In such a case, the amount of toner removed from the intermediate transfer belt 17 or the photoconductor drum 21 can be reduced without reducing the frequency of formation of the adjustment image. Accordingly, the amount of toner collected into the waste toner container 37 is reduced. In addition, the controller 11 may simultaneously perform a process for reducing the frequency of formation of the adjustment image according to the present exemplary embodiment and a process for changing the adjustment image into a simpler adjustment image according to the present modification.

Modification 2

The controller 11 may change the sequence of the process control process, the color regi control process, and the formation of the toner band 45 before and after the detecting unit 38 outputs a detection signal. For example, before the detecting unit 38 outputs a detection signal, the controller 11 may perform the formation of the toner band 45, the color regi control process, and the process control process in this order.

In contrast, after the detecting unit 38 outputs the detection signal, the controller 11 may perform the process control process before the color regi control process or the formation of the toner band 45 is performed. For example, the controller 11 reorders the color regi control process and the process control process so that the formation of the toner band 45, the process control, and the color regi control are performed in this order. In such a case, the process control is performed before the color regi control is performed, and the density of an image is adjusted. Therefore, even when the pattern 43 for correcting misalignment is formed, a variation in the density of the image is small. Thus, a variation in the estimated amount of collected toner with respect to the amount of the actually collected toner can be made small.

Modification 3

The length of the toner band 45 is not limited to that illustrated in FIG. 6. For example, if images are continuously formed on sheets having a small size, toner located inside of only a partial region of the developing device 24 may be replaced, and toner located inside of the other region may not be replaced. In such a case, in order to replace only the toner located inside of the other region, the toner band 45 having a length equal to the length of the other region may be formed. In addition, the shape of the pattern 41 for controlling the density, the number of the patterns 41 for controlling the density, and the color of the pattern 41 for controlling the density are not limited to those illustrated in FIG. 4. Any image usable for image density adjustment can be employed as the pattern 41 for controlling the density. Similarly, the shape of the pattern 43 for correcting misalignment and the number of the patterns 43 for correcting misalignment are not limited to those illustrated in FIG. 5. Any image usable for color registration error correction can be employed as the pattern 43 for correcting misalignment.

Modification 4

While the above-described exemplary embodiment has been described with reference to control of the frequency of formation of the pattern 43 for correcting misalignment or the toner band 45, the frequency of formation of an image other than the pattern 43 for correcting misalignment and the toner band 45 included in the adjustment image may be controlled. For example, after the detecting unit 38 outputs a detection signal, the controller 11 may reduce the frequency of formation of a toner band for forcibly ejecting the toner (hereinafter referred to as an "ejection toner band"). Alternatively, after the detecting unit 38 outputs a detection signal, the controller 11 may reduce the frequency of performance of the process control, that is, the frequency of formation of the pattern 41 for controlling the density. Note that in such a case, it is desirable that the frequency of performance of the process control after the detecting unit 38 outputs a detection signal be higher than the frequency of performance of the color regi control or the frequency of formation of the toner band 45.

Modification 5

While the above-described exemplary embodiment has been described with reference to reduction in the frequency of performance of the color regi control and the frequency of formation of the protection toner band 45, only one of the frequency of performance of the color regi control and the frequency of formation of the protection toner band 45 may be reduced. For example, if only the frequency of performance of the color regi control is reduced, it is not necessary to reduce the frequency of formation of an adjustment image other than the pattern 43 for correcting misalignment, that is, the pattern 41 for controlling the density and the toner band 45. In contrast, if only the frequency of formation of the protection toner band 45 is reduced, it is not necessary to reduce the frequency of formation of an adjustment image other than the protection toner band 45, that is, the frequency of formation of the pattern 41 for controlling the density, the pattern 43 for correcting misalignment, and the ejection toner band.

Modification 6

The above-described exemplary embodiment has been described with reference to reducing the frequency of the color regi control performed when the image forming apparatus 1 is powered on and the frequency of the color regi control performed when a temperature variation or a humidity variation inside the image forming apparatus 1 exceeds the threshold value. However, only one of the frequency of the color regi control performed when the image forming apparatus 1 is powered on and the frequency of the color regi control performed when a temperature variation or a humidity variation inside the image forming apparatus 1 exceeds the threshold value may be reduced. For example, the color regi control may be performed each time the image forming apparatus 1 is powered on both before and after the detection signal is output, and only the frequency of color regi control performed when a temperature variation or a humidity variation inside the image forming apparatus 1 exceeds the threshold value may be reduced in the above-described manner. Similarly, in order to reduce the frequency of formation of the protection toner band 45, at least one of the frequency of formation performed when the image forming apparatus 1 is powered on, the frequency of formation performed when the number of printed sheets counted after the protection toner band 45 was previously formed, and the frequency of formation performed when a temperature variation or a humidity variation inside the image forming apparatus 1 exceeds the threshold value may be reduced.

In addition, the timing at which the color regi control is performed and the timing at which the protection toner band 45 is formed are not limited to those described in the above exemplary embodiment. For example, in response to a request received from the user, the color regi control may be performed or the protection toner band 45 may be formed.

Modification 7

While the above-described exemplary embodiment has been described with reference to the detecting unit 38 that detects whether the amount of toner in the waste toner container 37 reaches the threshold value K1 by using an optical sensor, it can be detected whether the amount of toner in the waste toner container 37 reaches the threshold value K1 by using a technique without an optical sensor. For example, the detecting unit 38 may detect whether the amount of toner contained in the waste toner container 37 reaches the threshold value K1 by using a magnetic sensor. In such a case, the magnetic sensor measures the intensity of a magnetic field inside the waste toner container 37 and outputs a detection signal if the measured intensity reaches a value set in accordance with the threshold value K1.

Modification 8

While the above-described exemplary embodiment has been described with reference to the number of printed sheets and the number of pixels for determining whether the waste toner container 37 becomes full, only one of the number of printed sheets and the number of pixels may be used. In addition, the information regarding such a situation is not limited to the number of printed sheets and the number of pixels. For example, the number of rotation of the photoconductor drum 21 or the number of rotation of the transport member 34 can be used.

Modification 9

The shape of the cleaning member 31 or 33 is not limited to a blade shape. For example, the cleaning member 31 or 33 may be formed from a brush. In such a case, the cleaning device 20 or 26 removes toner by rotating the brush.

Modification 10

While the above-described exemplary embodiment has been described with reference to the configuration in which toner is removed from the photoconductor drum 21 and the intermediate transfer belt 17, a configuration in which toner is removed from only one of the photoconductor drum 21 and the intermediate transfer belt 17 may be employed. For example, if an image is transferred using a direct transfer technique, the necessity of the intermediate transfer belt 17 and the second transfer roller 18 can be eliminated. In such a case, since it is not necessary for the image forming apparatus 1 to remove toner from the intermediate transfer belt 17, the necessity of the cleaning device 20 can be eliminated. The image forming apparatus 1 can remove toner from only the photoconductor drum 21 using the cleaning device 26.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms, on an image bearing member, an image for adjusting operations of the image forming apparatus;

a container that contains toner removed from the image bearing member; and a controller that controls formation of the image for adjusting the operations of the image forming apparatus so that after an amount of toner contained in the container reaches a threshold value, an amount of toner removed from the image bearing member and to be contained in the container is reduced to less than before the amount of toner contained in the container reaches the threshold value.

2. The image forming apparatus according to claim 1, further comprising:

a detecting unit that detects that the amount of toner contained in the container reaches the threshold value and outputs a detection signal;

wherein the controller controls formation of the image after the detection signal is output by the detecting unit.

3. The image forming apparatus according to claim 1, wherein the controller reduces frequency of formation of the image for adjusting the operations of the image forming apparatus after the amount of toner contained in the container reaches the threshold value.

4. The image forming apparatus according to claim 3, wherein the image for adjusting the operations of the image forming apparatus includes a color registration error correction image used for correcting an error that is caused by incorrect color registration in an image, and wherein the controller reduces the frequency of formation of the color registration error correction image after the amount of toner contained in the container reaches the threshold value.

5. The image forming apparatus according to claim 3, wherein the image for adjusting the operations of the image forming apparatus includes a toner band, and wherein the controller reduces the frequency of formation of the toner band after the amount of toner contained in the container reaches the threshold value.

6. The image forming apparatus according to claim 1, wherein the image for adjusting the operations of the image forming apparatus includes a plurality of partial images, and wherein the controller reduces the number of the partial images after the amount of toner contained in the container reaches the threshold value.

7. The image forming apparatus according to claim 1, wherein the controller reduces the area of the image for adjusting the operations of the image forming apparatus after the amount of toner contained in the container reaches the threshold value.

8. An image forming method comprising:

forming, on an image bearing member, an image for adjusting operations of an image forming apparatus;

storing, in a container, toner removed from the image bearing member; and controlling formation of the image for adjusting the operations of the image forming apparatus so that after an amount of toner contained in the container reaches a threshold value, an amount of toner removed from the image bearing member and to be contained in the container is reduced to less than before the amount of toner contained in the container reaches the threshold value.

* * * * *